United States Patent [19]

Allert

[11] Patent Number: 4,708,512

[45] Date of Patent: Nov. 24, 1987

[54] CLAMPING SHELL

[76] Inventor: Kurt Allert, Panoramaweg 3, 7238 Oberndorf, Neckar, Fed. Rep. of Germany

[21] Appl. No.: 833,329

[22] Filed: Feb. 24, 1986

[30] Foreign Application Priority Data

Feb. 23, 1985 [DE] Fed. Rep. of Germany ..... 3506385

[51] Int. Cl.[4] ..... F16B 2/02

[52] U.S. Cl. ..... 403/344; 403/405.1; 24/285

[58] Field of Search ..... 403/344, 290, 312, 405.1, 403/49, 79, 373, DIG. 9, 310, 313; 24/20 LS, 19, 268, 279, 285

[56] References Cited

U.S. PATENT DOCUMENTS

| | | | |
|---|---|---|---|
| 812,162 | 2/1906 | Bemis | 403/312 |
| 1,596,944 | 8/1926 | Philbrook | 24/285 |
| 2,938,690 | 5/1960 | Castle | 24/279 |
| 3,056,571 | 10/1962 | Schofield et al. | 24/19 |
| 3,249,370 | 5/1966 | Brogden | 24/279 |
| 3,279,829 | 10/1966 | Kurtenacker et al. | 403/405.1 |
| 3,811,786 | 5/1974 | Valle | 403/313 X |
| 4,189,810 | 2/1980 | Beziat | 403/344 |

*Primary Examiner*—Richard J. Scanlan, Jr.
*Assistant Examiner*—Peter M. Cuomo
*Attorney, Agent, or Firm*—Erwin S. Teltscher

[57] ABSTRACT

A pivotally unfoldable clamping shell for releasably embracing and clamping parts to one another, includes two one-piece strip members which define respective half-shell regions, each having first and second ends; a center line is defined between the first and second strip member ends. A hinge member pivotally connects the strip members near the first ends thereof, and each second end of a corresponding strip member is bent so as to form a flange extending substantially parallel to the center line. Each strip member includes two strip elements juxtaposed with one another in a corresponding half-shell and flange region thereof, and the hinge member includes first and second lugs; at least one lug is formed by the strip elements of a corresponding strip member being connected to one another.

21 Claims, 11 Drawing Figures

PRIOR ART

FIG.5
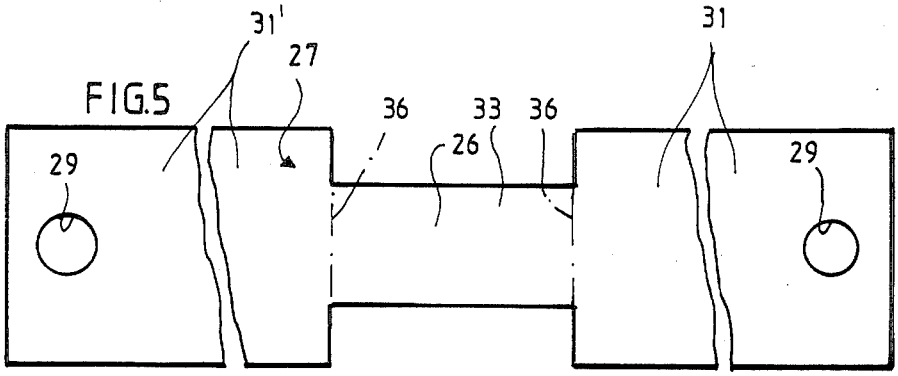
FIG.6
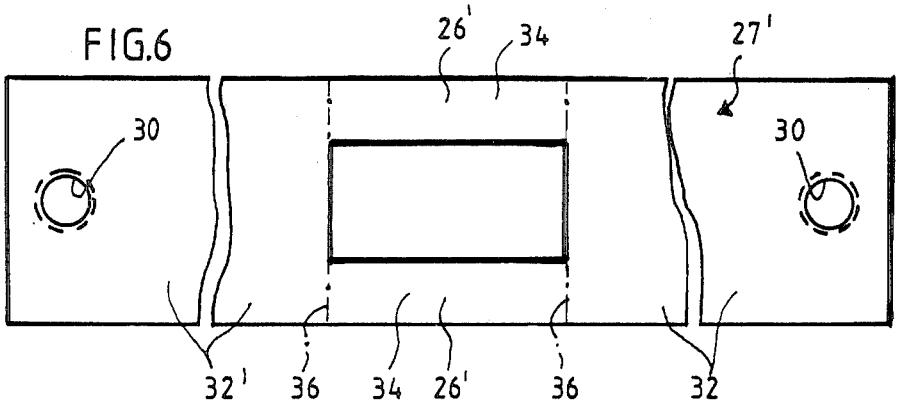
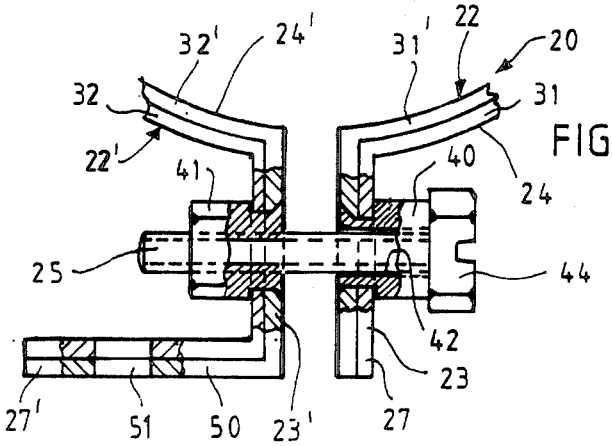
FIG.7

CLAMPING SHELL

FIELD OF THE INVENTION

The present invention relates to a clamping shell for releasable clamping or holding together of parts, such as rods, tubes, hoses, tubular segments or the like, and where the clamping shell is of two clamping shell portions articulatably connected to one another by means of a hinge, each being formed by a single one-piece strip or strip member; the strip or strip member of each half-shell forms at least one hook serving as a hinge, and one flange of that half-shell.

Each of two clamping shell halves or clamping ring halves have hitherto been fabricated from a metal strip; one end region thereof has been bent so as to form a flange, while the other end region thereof has been bent so as to form at least one hook.

BACKGROUND OF THE INVENTION

An embodiment of such a known clamping shell or ring 10 is shown in FIGS. 1 and 2. The two clamping ring parts 11 and 11' which are articulatably connected to one another by a hinge 9, are formed by a single bent metal strip 16. One set of free ends of the two single metal strips 16 are bent to form respective flat flanges 12 and 12' substantially extending at right angles to the corresponding tangent of the semi-cylindrical shells 13 and 13', while the other set of the free ends of the metal strips 16 are each bent into an almost, but not quite closed ring, so as to form hooks 14 and 14'. In the semi-cylindrical shell 11, as best seen in FIG. 2, there is disposed at a center thereof a single end hook 14 of a predetermined width, serving as a hinge, while two corresponding hooks 14', also serving as hinges, are disposed on each side of the centrally located hook 14, while having only one half of its width. The hooks 14' receive the centrally located hook 14 in a space available between the hooks 14'. A bolt 15 is inserted into hooks 14 and 14', so that the two rigid clamping shell parts 11 and 11' are rotatable with respect to one another about the longitudinal axis of the bolt 15. The two flanges 12 and 12' extend over the entire width of both strips 16, and are connected to one another by means of a screw 17, so as to tension the clamping ring 10. The screw 17 passes through one bore of the flange 12 with play, while being threaded into an inner thread of the other flange 12'.

By rotating the screw 17, the clamping ring 10 may be tensioned on rods, tubes, hoses, tubular segments or the like embraced thereby, so as to hold these elements together. So as to prevent deformation of the hooks 14', each of which is merely constituted by the respective strip 16 being bent into such a hook at a corresponding free end thereof, when a maximal tensioning force is used, the clamping ring 10 must be made of correspondingly thick metal strips 16. But even then the risk still remains that the tensioning forces are increased above a permissible limit, and that therefore the hooks 14, 14' are deformed by these excessive tensioning forces to such an extent, that they lose their hook shape, so that the clamping ring 10 then becomes unusable. As a result of the necessarily relatively thick strips 16, this type of clamping ring has a relatively high weight, and it is necessary to ensure that during tensioning the admissible tensioning forces are not exceeded. Also due to the relatively thick strips 16, the manufacturing costs of the clamping ring of the aforesaid construction are relatively high.

SUMMARY OF THE INVENTION

It is therefore an object of the present invention to devise a clamping ring or clamping shell of the type described in the "Field of the Invention" section, which at predetermined maximum tensioning forces can still be fabricated so as to be thin-walled, and wherein the hinges thereof can withstand particularly high tensioning forces.

This object is attained in a pivotally unfoldable clamping shell for releasably embracing and clamping parts to one another, wherein two one-piece strip members define respective half-shell regions, each having first and second ends, and wherein a center line is defined between the first and second strip member ends, by hinge means pivotally connecting the strip members near the first ends thereof. Each second end of a corresponding strip member is then bent so as to form a flange extending substantially parallel to the center line; each strip member includes two strip elements juxtaposed with one another in a corresponding half-shell and flange region thereof. The hinge means include first and second lugs, and at least one of the lugs is formed by the strip elements of a corresponding strip member being connected to one another.

The inventive clamping shell or ring may be stress-loaded at much higher tensioning forces at a given thickness of the semi-circular shells and the flanges of the two semi-circular shells, than a clamping shell or ring according to FIGS. 1 and 2, while simultaneously being of a simple and inexpensive construction. It differs from the clamping ring or shell of the prior art by not merely being formed with hooks serving at hinges. Furthermore in the inventive clamping ring the lugs of both clamping shells serving as hinges can no longer be deformed so as to lose their loop-shaped configuration, even if tensioning forces of the highest degree are used. The invention therefore makes it possible, at a given maximal tensioning force, to fabricate the novel clamping shell or ring from strips, such as metal and synthetic material or the like, whose thickness is substantially smaller than half the thickness of the strips of each semi-cylindrical shell of clamping rings of comparable size and width, such as the clamping ring of the conventional type, as shown in FIGS. 1 and 2. However, the novel clamping shell may be used for the same applications as the clamping rings according to FIGS. 1 and 2, and optionally, because of its improved properties, may even be used for other additional applications. Also the inventive clamping shell or ring, because of its lower material requirements, can be fabricated more economically than a comparable clamping ring of the construction shown in FIGS. 1 and 2.

A clamping ring of the inventive construction has been tested, in which each tubular semi-cylindrical shell has been fabricated of steel strips having a thickness of 1 mm. It withstood tensioning forces which, in the case of a conventional clamping ring of the same width and of the same diameter, namely as shown in FIGS. 1 and 2, would have required steel strips for both clamping shells having a thickness of at least 4 mm.

Also in the inventive clamping shell, because of the reduced thickness of both clamping shells, there occurs a significant saving of material and weight, and consequently a cost saving is achieved. Also the width of the inventive clamping shells or rings can be considerably reduced with respect to clamping rings of the prior art if the application permits such a reduction. Also the higher elasticity achievable due to the smaller thickness and/or width of each of the semi-cylindrical shells results in a favorable effect during its operation.

BRIEF DESCRIPTION OF THE DRAWINGS

FIGS. 5 & 6 are fragmentary exploded views of the strip members forming the two semi-cylindrical shells of the complete clamping shell according to FIGS. 3 and 4;

FIG. 7 is a detail of a clamping shell according to a further embodiment of the invention in front elevation;

DESCRIPTION OF THE PREFERRED EMBODIMENTS

Figure 1:
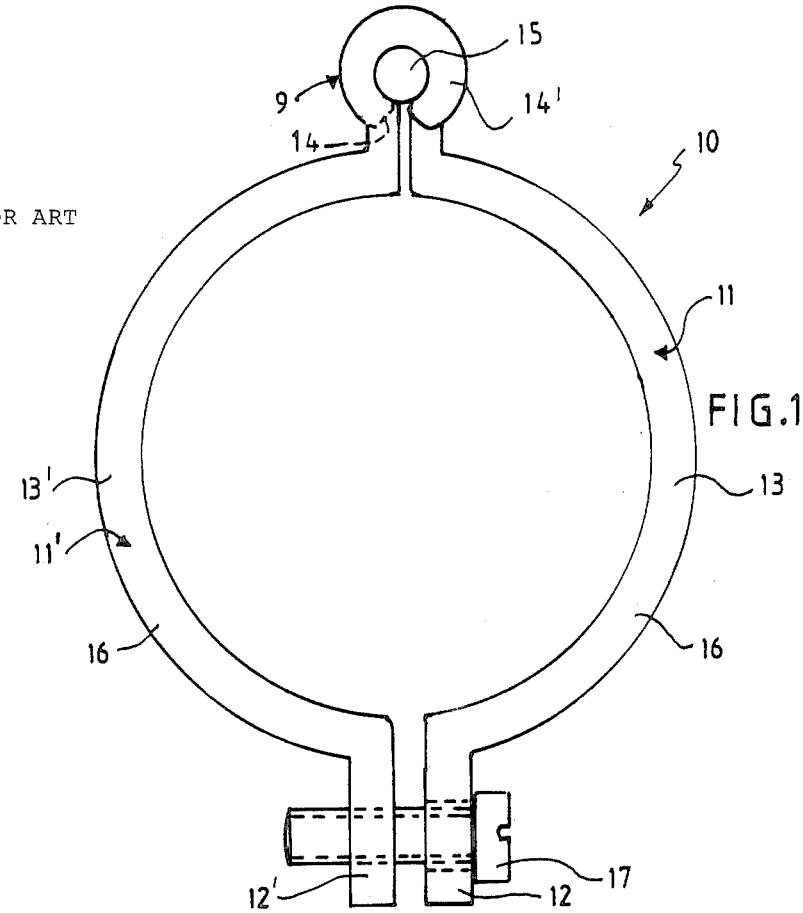
FIG.1 PRIOR ART
FIG. 1 is an elevation view of a clamping shell of the prior art.

The clamping shell 20 according to FIGS. 3–6 is formed of two clamping shell parts 22, 22' connected to one another articulatably by means of a hinge 21, and wherein the end regions facing away from the hinge 21 are flat flanges 23, 23', which extend outwardly substantially parallel to a center line C—C extending between the respective end regions of the clamping shell parts 22, 22'. The flanges 23 and 23' are connected to one another by means of a screw 25, so as to tension the clamping shell 20, and wherein the screw 25 passes through an aperture 29 of the flange 23 with play, and is threaded into a threaded bore 30 of the other flange 23'.

The clamping shell portion 22' includes two outer lugs 26', and the clamping shell portion 22 includes a center lug 26 having twice the width of each outer lug 26'. The clamping shell portion 22 extends between the two outer lugs 26' at a small play. A bolt 28 passes through the lugs 26, 26', permitting rotation of the two clamping shell parts 22 and 22' relative to one another about its longitudinal axis; the bolt 28 is also secured against any axial displacement, for example, by securement to the center lug 26. The bolt 28 can preferably be made of metal, but optionally may also be made of a non-metallic element, for example of hard synthetic material.

The lug means formed by the lugs 26, 26' and which serves as a hinge, extends over the entire width of the two separate strip members 27, 27'.

Figure 2:
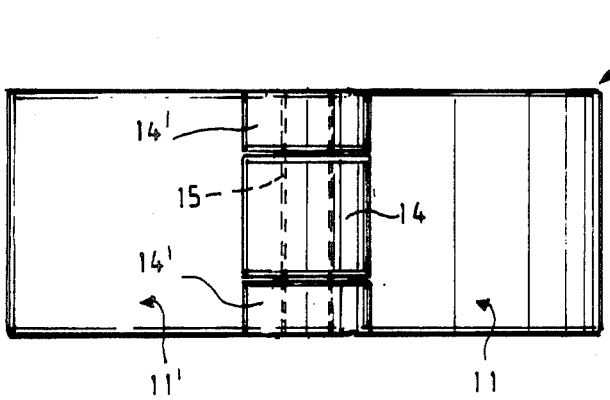
FIG. 2 is a top plan view of the clamping shell of the prior art.
Figure 3:
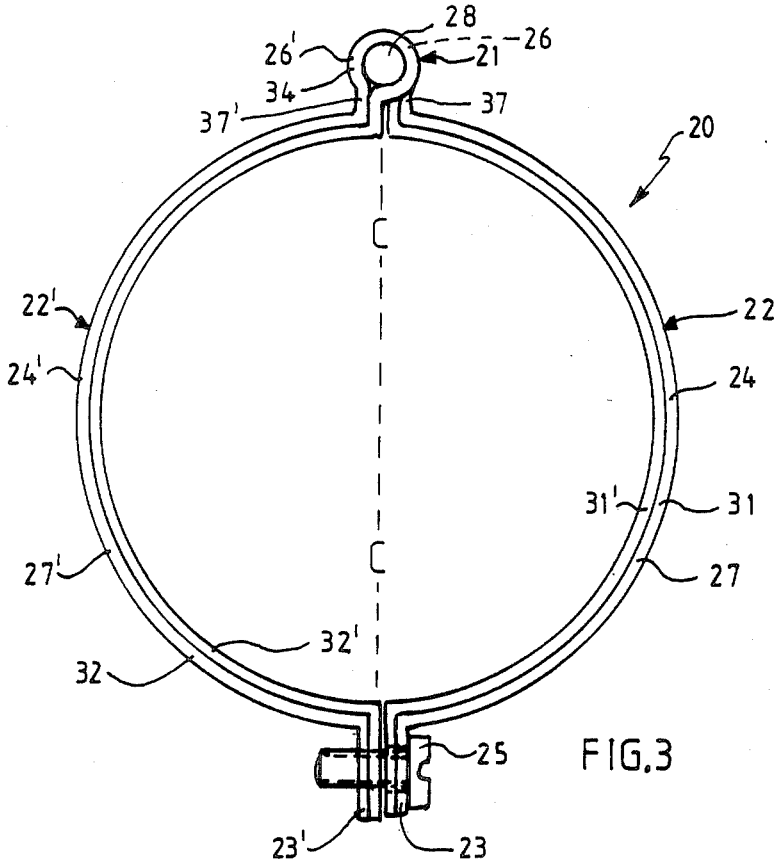
FIG. 3 is an elevation view of a clamping shell according to one embodiment of the invention.
Figure 4:
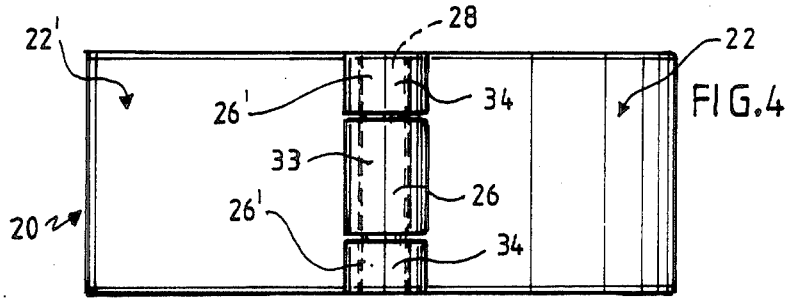
FIG. 4 is a plan view of the clamping shell according to FIG. 3.

Differing, however, from the construction of the clamping shell 10 of the prior art according to FIGS. 1 and 2, each of the clamping shell parts 22, 22' of the clamping shell 20, according to FIGS. 3 and 4, is formed by a single-piece strip member 27, and 27'; each strip member 27 or 27' is, in turn, formed of two strip elements 31, 31' in the region of the flanges 23 and 23', or of the semi-cylindrical shells 24 and 24', but is formed as a single strip member only in the region of the lug 26 or of the lug 26'. The two juxtaposed and abutting strip elements 31, 31' of the strip member 27, each of which has a constant width, extend from the free end of the flange 23 formed therefrom up to the lug 26 parallel to one another, and are connected as one piece through the loop-like region 33 of the strip 27, which has a relatively small length, but has a constant width. Two other strip elements 32, 32' of the strip member 27', each of which has a constant width, also extend from the free end of the flange 23' formed therefrom up to the lugs 26' parallel to one another, while being connected as one piece to one another by the loop-like and narrower regions 34 of the strip member 27; each region 34 has a relatively small length, but has a constant width, and the regions 34, as has already been stated, form the two outer lugs 26. These lugs 26, 26' serving together as a hinge, are shown here as approximately circularly-shaped or bent single strip element regions of the strip members 27, 27' of the respective clamping shell parts 22, 22'. These single strip element regions are formed from the region 33 of the strip member 27, and from both regions 34 the strip member 27' by bending. Consequently the respective strip members 27 or 27' in the region or regions, where each forms a respective lug 26, or lugs 26', is formed only as a single strip element; in contrast thereto, one strip element 33 and 34 of the respective strip member 27 or 27', of the cylindrical shell 24 or 24', and of the flange 23 or 23' of each cylindrical shell part 22 or 22' is formedof two respective juxtaposed strip elements 31, 31' or 32, 32' of the strip members 27 or 27', respectively, which abut one another along the full width and length of their respective regions.

The two semi-cylindrical shell parts 22 and 22' may preferably be rigid parts. If desired, it is also possible that the clamping shell parts are bendable preferably elastically bendable. Their strip members 27, 27' can preferably be made of metal, particularly steel, chrome-nickel steel, aluminum or brass, or also of non-metallic materials, such as synthetic materials or the like. This clamping shell 20 may find the same applications or use as the known separate clamping shells, but may optionally even have wider applications or use because of its improved properties.

The strip members 27, 27' forming the cylindrical shell parts 22 and 22', respectively, are shown in FIGS. 5 and 6 in a fragmentary and exploded manner. The lugs 26, 26' are being bent from strip regions of reduced thickness denoted by reference numerals 33 and 34. In the exploded view of the strip members 27 or 27' shown in FIGS. 5 and 6, the bending lines, which border the lugs 26 and 26', are shown dash-dotted and are designated by the reference numeral 36.

The strip members 27 and 27' of rectangular cross-sectional shape may preferably be punched from metallic bands or sheet metal. The strip members 27 and 27' may be of constant thickness, and their width is also preferably greater in the region of the lugs, preferably substantially greater than their thickness.

The two abutting strip elements 31, 31' or 32, 32' of the strip members 27 or 27' of the clamping shell parts 22 or 22', respectively, may, in the simplest care, be connected with one another only by means of the lugs 26 or 26', and wherein, in that case, advantageously there is provided only in the outermost strip element 32 of the flange 23' a threaded bore for the tensioning screw 25, while through the bore of the inner strip element 32', which is aligned therewith, there may be passed the threaded shaft of the screw 25 with radial play. Alternately the screw 25, after being passed through preferably non-threaded bores of the flanges 23 and 23', may be threaded into a separate and non-illustrated nut, which abuts the flange 23', or may be rigidly or pivotably secured thereto. Preferably, however, the respective opposite surfaces of the strip elements 31, 31' or 32, 32' may be connected to one another rigidly at least at one location, preferably point-wise or along respective surfaces, or over the entire respective opposite surfaces, for example by welding, adhesion, cold rolling, riveting or the like. Preferably, however, the two strip elements 31, 31' or 32, 32' may be connected to one another, apart from being connected through the lugs 26 or 26', by being only rigidly connected to the flange 23 or 23', while otherwise remaining unconnected, and only abut loosely to one another in the remaining regions. An embodiment of the invention of this type is shown in a fragmentary manner in FIG. 7, which shows a detail of a clamping shell 20, which differs from the embodiments of FIGS. 3–6 as follows:

The two strip elements 31, 31' of the strip member 27 of the clamping shell part 22 are further rigidly connected to one another by means of a hollow sleeve 40 formed with a bore 42, serving as a rigid connecting piece, onto which the head 44 of the screw 25 abuts during tensioning of the clamping shell 20, as illustrated; this rigid connection of the strip elements 31, 31' takes place on the flat flange 23 in a non-releasable manner. The hollow sleeve 40 also serves as an excellent abutment means for the head 44 of the screw 25. The threaded shaft of the tensioning screw 25 passes through the through bore 42 with radial play. Furthermore there is riveted to the flat flange 23' of the other clamping shell part 22' a nut 41 forming a rigid connecting piece, which connects the two strip elements 32, 32' of the strip member 27' on the flange 23 to one another rigidly and non-releasably, and into which there is threaded the screw 25 for tensioning of the clamping shell 20. Also here the strip elements 32, 32' are rigidly connected to one another apart from the lugs 26' only through the connecting piece 41. The connection of the strip elements 31, 31', or 32, 32' to one another only through the lugs 26 or 26', and through the connecting piece 40 or 41 results in a uniform introduction of any forces acting on the lugs 26, 26', and therethrough onto the strip elements 31, 31' and 32, 32' of the strip members 27, 27', respectively, occuring upon tensioning of the clamping shell since, on one hand, the strip elements are only connected to one another rigidly on the flange 23 or 23', respectively; on the other hand, the strip elements can glide slightly with respect to one another between a respective flange 23, 23' and the corresponding lugs 26, 26' so as to obtain an equalization of the forces which, in turn, permits the acceptance of unusually large tensioning forces. Furthermore, there is rigidly disposed on the flange 23' another flat holder 50, which is arranged, or extends at right angles thereto, and which is also formed by the two strip elements 32, 32' of the strip member 27'. The holder 50, as shown, forms a bent continuation of the flange 23', and is formed with at least one through-going aperture 51, or at least one threaded bore, and can therefore be secured to a carrier serving to carry the clamping shell 20, by means of nuts; a threaded rod can, for example, serve as such a carrier. Also other types of holders, such as a pin attached to the semi-cylindrical shell 24' can be disposed on the clamping shell 20 so as to carry it. Such a holder or several of such holders, for example the holder 50, permits use of the clamping shell 20 to hold sign-boards, scaffoldings or scaffolding rods, tubes and the like between the half-shells 24, 24', wherein only a single rod, tube or the like needs to be embraced thereby under tension. It can also serve, as shown by the clamping shell 20 according to FIGS. 3–6, for holding together two or more parts inserted between the cylindrical half-shells 24 and 24', such as, for example for holding together a tubular piece or the like formed by segments, of two rods telescoping into one another, of tubes, or the like, of parts slidable into one another, as for example, for holding of a hose on one or two tubular parts inserted therein, and the like. The clamping shell 20 may also have other arbitrary uses, for example, serve for carrying rigid or flexible conduits, and the like.

As can be seen without any difficulty from FIG. 3, it is possible to pivotally unfold the two clamping shell parts 22, 22' of the clamping shell 20 by more than an angle of 180°, for the purpose of inserting parts to be held therebetween, or tensioned by the clamping shell 20, if the screw 25 is unscrewed from the associated threaded bore of the clamping shell part 32'. It is also possible to insert the parts to be tensioned between the clamping shell parts 22, 22', or to withdraw them therefrom, if the screw 25 is loosened; also the hinge 21 permits a secure tensioning, holding or holding together of parts inserted between the clamping shell parts 22, 22', even if the clamping shell parts 22 and 22' are rigid.

Figure 11:
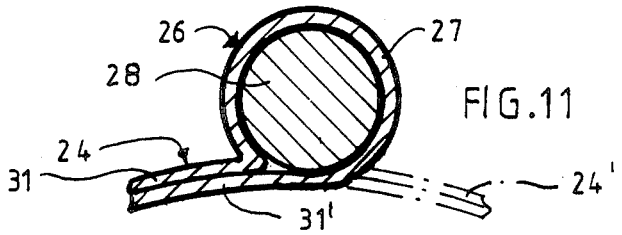
FIG. 11 is a large scale section of a part of the clamping shell of the semi-cylindrical shell according to FIG. 8, seen along the section line 11—11 of FIG. 9, and wherein the other semi-cylindrical shell has been indicated only schematically in dash-dotted lines.
Figure 8:
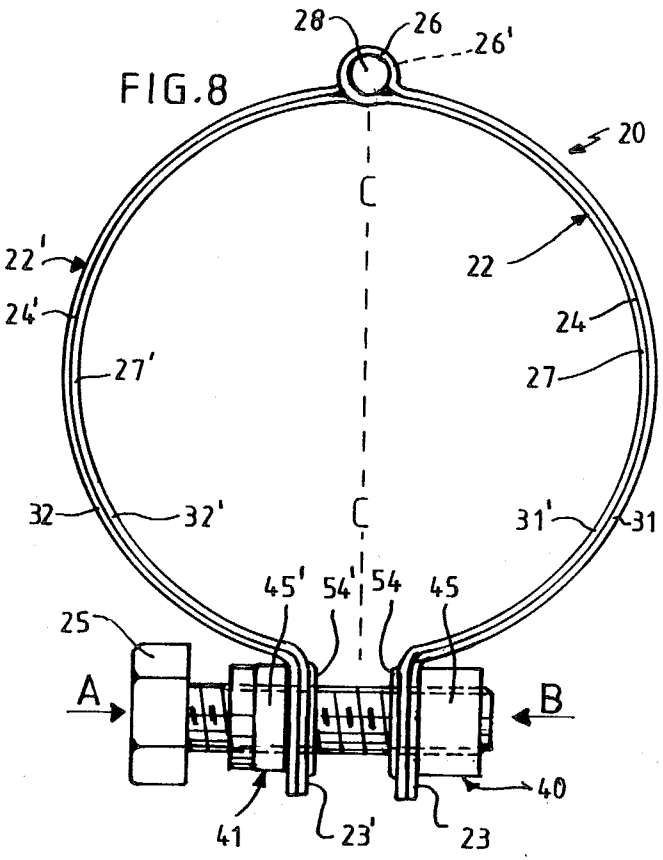
FIG. 8 is a clamping shell according to a still another embodiment of the invention in front elevation.
Figure 9:
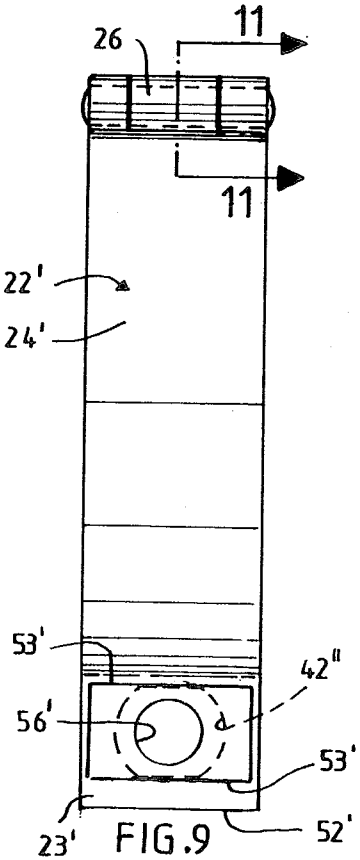
FIGS. 9 & 10 are respective left and right side views of the clamping shell according to FIG. 8, seen in the direction of the arrow A (FIG. 9), or arrow B (FIG. 10), and wherein the tensioning screws have been omitted for clarity's sake.
Figure 10:
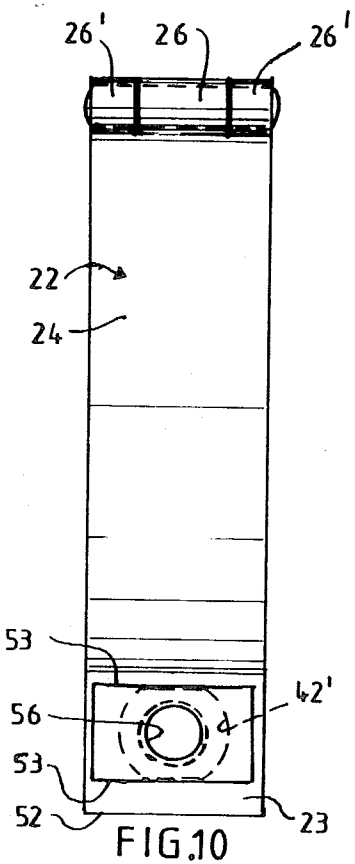

The clamping shell 20, according to FIGS. 8–11, differs from those shown in FIGS. 3–6 substantially only as it concerns the flanges 23 and 23', and also in the following detail:

In the two clamping shell parts 22, 22' of the clamping shell 20, according to FIG. 3, the lug 26 or the lugs 26' of the respective clamping shell part 22 or 22' are disposed on a respective short, straight, neck region 37 or 37' extending parallel to the center line C—C, and made up of the two separate strip elements 31, 31' and 32, 32' of the corresponding semi-cylindrical shell 24 or 24'; due to this construction the two cylindrical shell parts 22 and 22' may be pivotally unfolded from one another at a particularly wide angle. However, in the clamping shell, according to FIGS. 8–11, the loop-type, single layer, lugs 26 or 26' of the respective clamping shell part 22 or 22' merge directly with the end of the circular arc of the corresponding cylindrical shell 24 or 24' as shown, i.e. a line at right angles to the center line C—C is concomitantly a tangent to the loop-shaped lug 26, or lugs 26'. A bolt 28, as best seen in FIGS. 8 and 11, passes through the lugs 26 and 26'. Even extremely large tensioning forces cannot deform this clamping shell 20 or can deform it at most in an insignificant manner.

In the clamping shell 20, according to FIGS. 8–11, the respective strip members 27 and 27' of constant thickness formed from the strip elements 31, 31', and 32, 32', are connected to the respective flanges 23 or 23' in a manner similar to that of the embodiments shown in FIG. 7, by a rigid one-piece connecting member 40 or 41 in a non-releasable manner. These connecting members 40, 41 have an approximately parallelepiped elongated section 45, 45' with a longitudinal rectangular contour, which section abuts tightly the respective side of a flange 23, 23' facing away from the other flange 23' or 23, and whose longitudinal sides 53 or 53' extend transversely to the longitudinal direction of the flange 23 or 23', namely extend parallel to the respective free edges 52 or 52' almost over the whole width of the respective flange 23 or 23'.

The two strip elements 31, 31' or 32, 32' of the strip member 27 or 27' always abut one another along their entire constant width and length, and apart from being connected through the corresponding connecting piece 40 or 41, are only connected to one another by the corresponding lug 26 or lugs 26'.

Each flange 23 or 23' is formed with a longitudinal slit 42' or 42'', through which pass riveted-on projections of the corresponding connecting members 40, 41, secured in turn to the flanges 23, and 23', respectively, so as to prevent the riveted-on projections from rotating. The portion of each riveted-on projection disposed in the longitudinal slits 42' or 42'' is milled to the width of the respective rectangular segment 45 or 45', that it is therefore formed with two parallel chamfers, which are, in turn, aligned with the bordering longitudinal sides 53 or 53' of the rectangular segments 45 or 45'. The connecting members 40, 41 can accept extremely large tensioning forces. On the inner side of the flange 23 or 23' the riveted-on projection at 54 and 54' is flanged outwardly, so that therefore the connecting member 40 or 41' is non-releasably riveted to the flange 23, 23'; additionally it is secured form-lockingly against rotation.

The connecting member 41 is provided with a smooth bore 56', and the connecting member 40 is formed with a threaded bore 56. A tensioning screw 25 is threaded into the threaded bore 56, which passes through that bore 56, and serves for tensioning the clamping shell 20.

Based on the parallelepiped-shaped segments 45, 45' of these two connecting members 40, 41, particularly large tensioning forces can be exerted by means of the tensioning screw 25 onto the flanges 23, 23', and consequently on the clamping shell 20 without there occuring any risk of overloading the flange.

In the embodiments according to FIGS. 3–11, the strip members 27, 27' of the clamping shell portions 22 or 22' have rectangular cross-sections; however, it is also possible to form those cross sections at least in a part-region of the clamping shell portions 22 and 22' so as to be slightly arcuate, preferably outwardly concave, and/or provide them with stiffening ribs or the like by stamping.

Although the strip member 27 and 27' have an approximately constant thickness, in many cases it may adantageous that at least one strip member has a variable thickness along its length, i.e. may, for example, by thicker in the region of the lug 26, or of the lugs 26', than in the half-shell regions containing each the two strip elements 31, 31', or 32, 32', respectively.

I claim:

1. A pivotally unfoldable clamping shell for releasably embracing and clamping parts to one another, comprising in combination two one-piece strip members defining respective half-shell regions, each having first and second ends, a center line being defined between said first and second strip member ends, hinge means pivotally connecting said strip members near the first ends thereof, each second end of a corresponding strip member being bent so as to form a flange extending substantially parallel to said center line, and clamping means arranged at said flanges of said strip members and operative for drawing said strip members toward one another and toward said center line for clampingly engaging said half-shell regions, each strip member including two strip elements juxtaposed with one another in a corresponding half-shell and flange region thereof and having respective major surfaces which face each other and are in an area contact with one another at said half-shell and flange regions thereof, said hinge means including first and second lugs, at least one of said lugs being formed by the strip elements of a corresponding strip member being connected to one another.

2. The clamping shell as claimed in claim 1, wherein each flange is bent in an outward direction.

3. The clamping shell as claimed in claim 1, wherein the strip elements of at least one strip member abut one another in at least one region where they are juxtaposed, and are rigidly connected to one another at least over a part of the abutting region.

4. The clamping shell as claimed in claim 3, wherein said strip elements of said at least one strip member are rigidly connected to one another at least over a part of their flange region.

5. The clamping shell as claimed in claim 1, wherein said strip elements of said at least one strip member are connected to one another only through the corresponding lug.

6. The clamping shell as claimed in claim 5, wherein said strip elements of said at least one strip member are further connected rigidly to one another through a single location at their flange regions.

7. The clamping shell as claimed in claim 4, further comprising a connecting piece formed with a through bore, said strip elements of said at least one strip member being rigidly connected to one another by means of said connecting piece.

8. The clamping shell as claimed in claim 7, wherein said connecting piece is riveted to the corresponding flange.

9. The clamping shell as claimed in claim 7, wherein said through bore is a threaded through bore.

10. The clamping shell as claimed in claim 7, wherein the flange of said at least one strip member is formed with a non-circular aperture, said connecting piece being form-lockingly inserted into said non-circular aperture.

11. The clamping shell as claimed in claim 10, wherein said non-circular aperture is substantially rectangular.

12. The clamping shell as claimed in claim 7, wherein each flange extends in an outward direction, and wherein said connecting piece has a portion of a rectangular cross-section abutting a corresponding flange on an exterior side thereof, said rectangular portion having a longitudinal side extending along a direction transverse to said outward direction.

13. The clamping shell as claimed in claim 1, wherein said strip members are made of metal.

14. The clamping shell as claimed in claim 1, wherein said strip members are made of synthetic material.

15. The clamping shell as claimed in claim 1, wherein said strip members are rigid.

16. The clamping shell as claimed in claim 1, further comprising holding means secured thereto.

17. The clamping shell as claimed in claim 16, wherein said holding means are formed by a corresponding flange being bent at a free end thereof in a direction transverse to the center line.

18. The clamping shell as claimed in claim 1, wherein said half-shell regions are arcuate, and wherein said lugs border said strip members near their first ends.

19. The clamping shell as claimed in claim 18, wherein said arcuate regions have an approximately semi-circular cross-section of a radius within a range between 5 to 200 mm, and wherein said strip elements each have a thickness within a range of 0.5 to 3 mm, and a width in said arcuate regions within a range of about 8 mm to 50 mm.

20. The clamping shell as claimed in claim 1, wherein said strip elements have an approximately constant thickness, and have an approximately constant width in said half-shell regions.

21. The clamping shell as claimed in claim 1, wherein each of said strip members has a predetermined width and a predetermined length; and wherein said major surfaces of said strip elements are in area contact with one another over the entire width and length of said half-shell and flange regions.

* * * * *